US005423370A

United States Patent [19]

Bonnemasou et al.

[11] Patent Number: 5,423,370

[45] Date of Patent: Jun. 13, 1995

[54] FOUNDRY SAND CORE REMOVAL AND RECYCLE

[75] Inventors: Ronald Bonnemasou; Hugo J. d. F. Filho; Lauro da Costa, all of Sao José dos Campos, Brazil; Karen Bickford, Princeton; Anthony DiNunzi, Middlesex, both of N.J.

[73] Assignee: Procedyne Corp., New Brunswick, N.J.

[21] Appl. No.: 206,088

[22] Filed: Mar. 4, 1994

[51] Int. Cl.[6] ..... B22D 29/00

[52] U.S. Cl. ..... 164/132; 164/5; 241/DIG. 10

[58] Field of Search ..... 164/132, 5; 241/DIG. 10

[56] References Cited

U.S. PATENT DOCUMENTS

| | | | |
|---|---|---|---|
| 4,177,952 | 12/1979 | Rikker | 241/DIG. 10 X |
| 4,411,709 | 10/1983 | Nakanishi | 164/132 X |
| 4,636,168 | 1/1987 | Sandstrom et al. | 164/5 X |
| 4,738,615 | 4/1988 | Bailey et al. | 164/5 X |
| 5,253,698 | 10/1993 | Keough et al. | 164/5 X |
| 5,271,450 | 12/1993 | Bailey | 164/5 |
| 5,279,741 | 1/1994 | Schott | 164/5 X |
| 5,294,094 | 3/1994 | Crafton et al. | 164/132 X |

*Primary Examiner*—J. Reed Batten, Jr.

*Attorney, Agent, or Firm*—Kane, Dalsimer, Sullivan, Kurucz, Levy, Eisele & Richard

[57] ABSTRACT

Metal parts formed by casting in a foundry and which contain the sand cores used to form internal passages are cleared of the sand cores by subjecting them to temperatures sufficient to pyrolyze and/or combust the bonding agents holding the sand cores together, in a fluidized-bed furnace.

12 Claims, 2 Drawing Sheets

FOUNDRY SAND CORE REMOVAL AND RECYCLE

BACKGROUND OF THE INVENTION

1. Field of the Invention

The present invention relates to the field of ferrous and nonferrous metal casting and in particular to the debonding and removal of sand cores from cast parts, and in some cases, the heat treating of the cast parts in conjunction with the removal of sand cores.

2. Brief Description of Related Art

In the casting of ferrous and nonferrous metals into parts, the foundries in the United States consumed 7.7 million tons of foundry sand in the year 1988 alone.

The steel foundries and many of the gray iron foundries use high purity (over 98% by wt. $SiO_2$) silica sand for casting molds. Many of the automotive foundries use a less pure (over 93% by wt. $SiO_2$) silica sand.

Most of this sand is used by the foundries for molding or core making. When making molds or cores, a binder material is added to the foundry sand to form the mold or the core. In general, the mold forms the outside surfaces of the casting, while the cores form the inside surfaces and paths.

The cast part is formed by pouring the molten ferrous or nonferrous metal into the mold. When the part has internal openings or paths, the molten metal is poured into the volume between the mold and the core(s) usually surrounding some or most of the core. When the metal solidifies, the mold is opened and the part is removed. In most cases, the core remains in the interior regions its presence has formed and must be removed.

Removal of the cores is usually accomplished by impact and vibration devices, and/or by heating to destroy the binders and/or manually by breaking and prying out of the cores. The cores are generally broken into smaller pieces within the part and can be removed through various part openings. The degree of difficulty of doing this "sand core debonding" depends upon the geometry of the part being cast.

There are a number of binder systems used for the bonding of foundry sand into sand molds and sand cores, the major ones being identified in the trades by the following nomenclature:

Furna No-Bake
Phenolic Urethane Cold Box
Penolic Urethane No-Bake
Shell Resin
Phenolic Hot Box
Silicates (No-Bake & $CO_2$)
Phenolic No-Bake
Alkyd Oil No-Bake
Core Oil The "No-Bake" sands are ones in which foundry sand, plus a binder and an appropriate catalyst or accelerator produces a moldable sand mixture which hardens by a chemical process. The other type binder systems are heat cured for hardening. Cold box binder systems cure very rapidly in seconds due to chemical reaction between components of the system. These systems are well known and used by those skilled in the art.

In most cases the mold is used once and is destroyed by the casting process. In all cases the sand core is destroyed by the casting process or by the method used for the sand core debonding from the cast part.

As those skilled in the art will appreciate, the debonding and removal of sand cores from a complex cast part is a difficult and costly process relative to the other aspects of a ferrous or nonferrous metal casting operation.

In the case of casting parts of aluminum or aluminum alloys, it is particularly difficult to remove the sand core because of the lower casting temperature used. A lower interface temperature, usually results in less separation of the sand core from the aluminum part. The aluminum also is a softer material and more prone to damage if physical impact is used in the debonding and removal process. In addition, it is necessary to cool the aluminum part substantially before any attempt is made to debond and remove the sand core by any reasonable physical means, or the soft part will be damaged by even modest handling.

When heating methods are used to remove sand cores by thermal destruction of the binder systems, heating cycles are typically long, 4 to 10 hours, and the removal of the core is frequently incomplete. Pieces of sand core remain where the heating process did not effectively thermally decompose all parts of the sand core.

Additionally, sand core material removed from the castings must be disposed of or reclaimed. Disposal has become increasingly expensive because the binder residue is usually classified as a hazardous and/or toxic waste which must be handled accordingly. Reclamation of the foundry sand through physical and thermal processing steps is receiving increasing attention, but also involves a significant cost.

This invention involves the use of the fluid bed furnace for the removal of sand cores used to form internal passages and other details when casting metal parts. This invention eliminates the major processing disadvantages encountered with existing methods employed for sand core debonding by:

1. requiring no hammering or impacting of the parts to break-up or loosen the sand cores;
2. debonding the sand cores in a way that eliminates toxic and/or hazardous components introduced with the binder system thereby eliminating an environmentally adverse impact of the foundry industry;
3. in the majority of the cases, recovers the sand used to form the sand core sufficiently pure so that it is unnecessary to dispose of, reclaim separately, or replace this material in foundry processing; and
4. by making it technically feasible to introduce the cast parts into the sand core debonding process immediately after casting and while the parts are still at a sufficiently high temperature to require little or no energy input of the sand core debonding process.

Fluid bed furnaces are well-known in the metal treatment arts for their advantages of rapid and uniform heat transfer, ease of use, and safety. See, for example, U.S. Pat. No. 3,053,704 which is incorporated herein by reference thereto. Conventional fluidized bed furnaces may comprise a retort or treating vessel containing a finely divided particulate solid heat transfer medium, e.g. silica sand or aluminum oxide. A distributor plate is positioned at the lower end of the retort for introducing fluidizing gas to the retort upwardly through the bed media from a plenum chamber below. The fluidizing gas suspends the bed media in an expanded mass that behaves like a liquid. Heat is transmitted to the expanded mass from electric heaters, or the like, either directly or through the walls of the retort and/or the fluidizing gas may be heated before it enters the retort.

A workpiece submerged in the heated expanded mass is rapidly and uniformly heated.

The workpiece(s) are typically placed in fixtures or baskets which are submerged in the fluidized bed furnace fluidized medium.

In the fluidized bed furnace, the parts can be heated or cooled very uniformly through conduction of heat into the fluidized medium and/or by adjusting the temperature of the fluidizing gas causing fluidization of the particulate medium.

In addition, the surface of the parts and the particulate medium are subjected to the sweeping action of the fluidizing gas.

This invention uses the properties of the fluidized bed furnace system to advantage in the debonding and removal of sand cores from cast parts, and in some cases, for the heat treating of the cast parts in conjunction with the removal of sand cores.

SUMMARY OF THE INVENTION

The invention comprises a method or process of removing sand core from a metal part cast in a mold which includes a bonded sand core to form an internal passage, which comprises:

subjecting the part containing the sand core to heat at a temperature sufficient to pyrolyze the sand core bonding system, in a fluidized bed of solid particles.

The method of the operation provides a means to remove sand cores from cast metal parts, economically and with labor saving. The sand recovered can be recycled for further foundry use.

DETAILED DESCRIPTION OF THE PREFERRED EMBODIMENTS OF THE INVENTION

Figure 1:
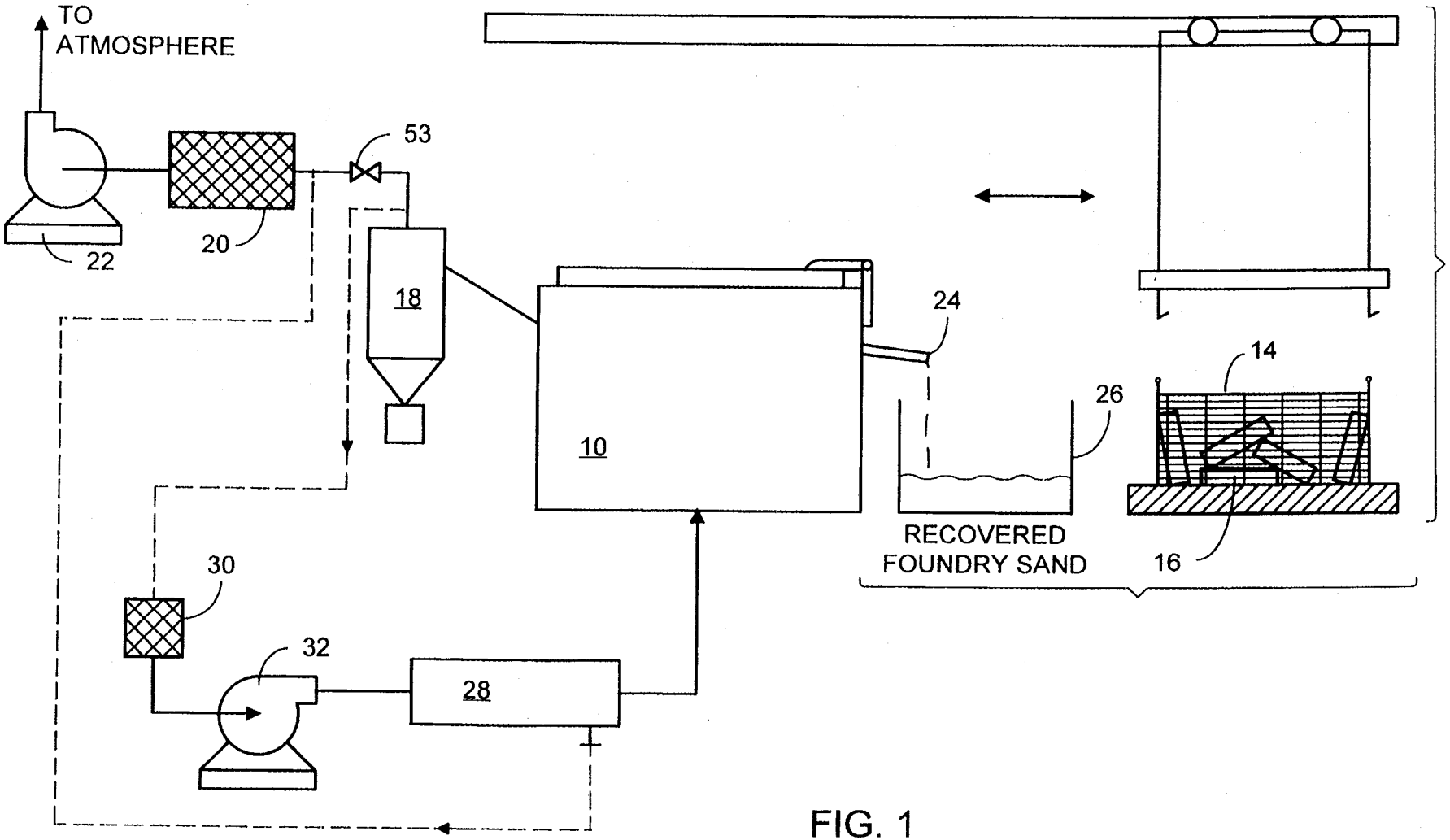
FIG. 1 is a diagrammatic scheme showing the overall process of the invention.
Figure 2:
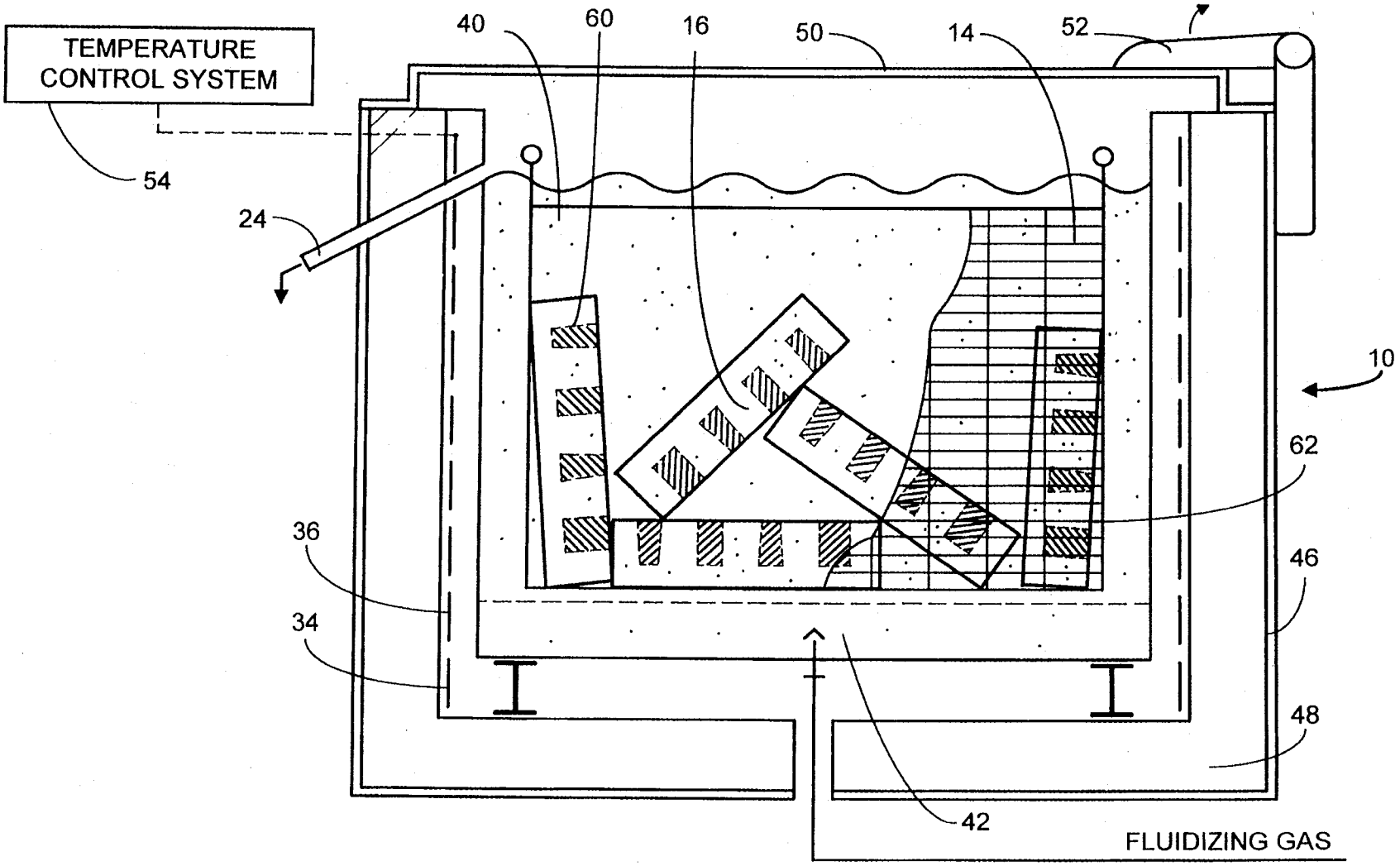
FIG. 2 is cross-sectional side elevation of a fluid-bed furnace used in the process of the invention.

Those skilled in the art will gain an appreciation of the invention from a reading of the following description of the preferred embodiments when viewed with the accompanying drawings of FIGS. 1 and 2.

Referring first to FIG. 1, there is seen diagrammatically a process line for carrying out the method of the invention.

A fluidized-bed furnace 10 is provided to receive from an overhead hoist 12 baskets 14 of cast metal parts 16 containing bonded sand cores.

When casting parts from molten metal, the metal is solidified around the sand cores used to form the interstices or internal passage ways in the part.

The parts 16 carried by basket 14 and still containing the sand core(s) is submerged in a fluidized bed preferably of the same foundry sand as is used to make the sand cores.

The fluid bed furnace 10 is operated and controlled at a temperature typically in the range of 600° F. to 1800° F., most typically 850° F. to combust or pyrolyse the binder used to form the sand core.

The metal part 16 including the sand core(s) are increased in temperature to the operating temperature of the fluid bed. The chemical bonding agents used to form the sand core are pyrolyzed and/or combusted to gases and residual carbon. The fluidizing and pyrolysis gases and some solid particles entrained in these gases leaving the fluidized bed of furnace 10 are separated in cyclone separator 18. The gases can be further cleaned in a wet scrubber or in a suitable filter unit 20 and then exhausted to the atmosphere through exhauster 22.

This process destroys the bonding of the sand core and the sand becomes loosened; some leaving the internals of the cast part and some remaining within the part in a free granular state. The recovered sand adds to the fluidized bed, and surplus can be removed in an overflow conduit 24 directed to recovery bin 26 for re-use in the foundry.

If the part 16 is maintained in the fluid bed furnace 10 for a sufficiently long period of time typically 30 minutes to 120 minutes, the carbon is oxidized, the sand core becomes completely loose and granular, and the only remaining components remaining in the sand are any non-reactive, non-volatile inorganic materials that might have been added as part of the core bonding system. These are typically fine powders which can be removed from the bed by being entrained in the fluidizing gas and/or a small amount may be retained in the fluid bed foundry sand to be cleaned, i.e., removed from the foundry sand when there is sufficient contamination to justify the cleanup. There are known processing methods to remove this fine particle inorganic contamination from foundry sand, such as pneumatic scrubbing.

When the cast parts 16 are removed from the fluid bed furnace 10 the remaining foundry sand drains away from the part by gravity. This removal of the sand can be enhanced by shaking or vibrating the parts and finally subsequent cleaning; either air blowing, water washing or other similar activity.

As shown in the FIG. 1, efficiency of the overall process can be improved by heat exchanging the fluidized gas in heat exchanger 28 by closing valve 53 and directing the high temperature discharge gases from cyclone 18 through the dotted lines shown in FIG. 1 to recover some of the heat from these gases by heating the cool fluidizing gas. The fluidizing gas is fed to furnace 10 through a filter 30 and through blower 32.

Although any gas medium conventionally used in a fluidized bed furnace may be used, air is preferred for the present invention. Non-oxidizing atmospheres would include the use of inert gases such as argon and nitrogen.

Referring now to FIG. 2, there is seen a cross-sectional side view the fluidized bed furnace 10 loaded with the basket 14 previously described.

A group of cast parts 16 such as a plurality of automotive manifold parts as shown in FIG. 2 are contained in the basket 14 fixture shown. The parts 16 each contain bonded sand cores 60 which formed their internal passages. Surrounding the basket 14 of parts 16 is a fluid bed retort furnace operating at circa 850° F. The granular medium 40 in the plenum chamber 42 of the fluid bed furnace retort is preferably the same foundry sand as was used to make the cores 60 that are still retained in the parts 16.

The fluidizing gas is preferably air. The retort 62 is heated and controlled at operating temperature by the electrical heating mantle 34 shown and the temperature control system 54 which modulates the current to the electrical resistance heaters 36 or other heating elements, to provide the required energy to the system. The heating mantle 34 may be fuel fired instead of electrically heated. In some cases the electric heating mantle may be replaced by heating the fluidizing gas to a sufficiently high temperature prior to feeding to the fluidized bed in furnace 10.

The fluidizing air leaving the fluid bed retort 62 is propelled by exhauster 22, which directs this off-gas to the atmosphere or to a gas cleanup system if the level of organic binder in the sand cores is sufficiently high to require cleanup of the off-gas. This cleanup process can be afterburning and/or wet scrubbing depending upon the compounds present in the sand core binder. The furnace 10 is enclosed by heating mantle insulating wall 48 contained by outside shell 46.

The cover 50 of the fluid bed retort 62 is opened on hinge 52 and the basket 14 of parts 16 is submerged in the fluid bed 40 as shown in FIG. 2.

Typically the furnace 10 temperature drops due to the introduction of the cooler parts 16 and basket 14 and the temperature control system 54 increases the energy input of the heating mantle 36 and the furnace 10 returns to controlled operating temperature. Following time in the furnace determined by the geometry of the parts 16 the bonding system used to form the sand cores, and the type of material being cast, the core 60 is debonded, the foundry sand becomes loosened and clean, and the basket 14 of parts 16 can be removed from the furnace 10.

In the case of the sand core 60 debonding of aluminum parts 16 the operation is sometimes followed by a heat treatment, for example, solution treating. This solution treating is typically accomplished at 1000° F. for from 4 to 10 hours. In these cases, if the sand core 60 debonding is carried out at a temperature of approximately 1000° F., then part of the solution treating process is carried out during the sand core debonding operation, reducing costs and improving efficiency. The remainder of the solution treating process can then be carried out by keeping the basket 14 of parts 16 in the fluid bed furnace 10 for the remainder of the time required for solution treating or the basket 14 of parts 16 can be transferred to an alternate furnace to complete the process. At the completion of the solution treatment phase of the cycle, the basket 14 of parts 16 are typically cooled by quenching, typically in water. This operation completes the heat treatment and serves to wash any residual foundry sand from the parts 16.

The following example shows the manner and the process of carrying out the invention and sets forth the best mode contemplated by the inventors for carrying out the invention.

Sand Core Debonding of Aluminum Engine Manifolds

Using a fluidized-bed furnace as described above, an initial test application involved sand debonding of aluminum automobile engine manifolds. The design basis and processing parameters were as follows:

| | |
|---|---|
| Manifold weight with sand cores: | 8 lbs. |
| Manifold weight, after debonding: | 7 lbs. |
| Basket working volume: | 60" diameter<br>80" high |
| Number of Manifolds per load: | 40 (average) |
| Fluid Bed Operating Temperature: | 850° F. |
| Processing time after loading: | 90 minutes |

Each basket load was withdrawn from the fluid bed furnace ninety minutes after loading and all sand cores were found to be completely debonded. The parts were blown with air to remove loose foundry sand particles.

The process of the invention may be carried out in batch procedures with a plurality of parts batches being handled separately. Preferably, a continuous procedure is contemplated wherein the fluidized bed is charged continuously with loading at given points in time and unloading at subsequent points.

We claim:

1. A process to remove the sand cores from a metal part cast using granular sand bonded together with a chemical bonding agent to form the sand cores, which comprises;

(a) placing the part in a bed of fluidized solid particles; and (b) heating the part in the fluidized bed to a temperature level sufficiently high to pyrolyze the sand core bonding agent whereby the sand cores debond and return to granular sand which can be poured from the part.

2. The process of claim 1 wherein the fluidized bed temperature is in the range of 600° F. to 1800° F.

3. The process of claim 1 wherein the fluidized solid particles comprise the same sand as the sand cores.

4. The process of claim 1 wherein the metal parts are aluminum or an alloy of aluminum whereby the sand core debonding can be performed simultaneously with part or all of a metal heat treating.

5. The process of claim 1 wherein the debonding is accomplished batch-wise.

6. The process of claim 1 wherein the debonding is accomplished in a continuous fluid bed furnace and the metal part are successively fed to the furnace at one point and are removed at another point.

7. The process of claim 1 wherein the bonding agent in the sand core(s) contains no inorganic materials or other materials that do not pyrolyze or at elevated temperatures.

8. The process of claim 1 wherein the bonding agent in the sand core contains inorganic materials or other materials that do not pyrolyze at elevated temperatures and where the inorganic materials become powders and are removed from the fluid bed furnace retort by entrainment with exiting fluidizing gases.

9. The process of claim 1 wherein the bonding agent in the sand core contains inorganic materials or other materials that do not pyrolyze at elevated temperatures and are retained in the fluidized bed.

10. The process of claim 1 wherein the parts are fed to the fluid bed furnace immediately following casting so they are at an elevated temperature and impose no energy load on the furnace while the process is accomplished.

11. The process of claim 1 wherein the fluidizing gas is an inert gas.

12. A process of removing a sand core from a metal part cast in a mold which includes a core which comprises granular sand bonded together with a chemical bonding agent to form an internal passage, which comprises:

subjecting the part containing the sand core to heat at a temperature sufficient to pyrolyze the chemical bonding agent, in a fluidized bed of solid particles.

* * * * *